US010183487B2

(12) United States Patent
Kanzaki et al.

(10) Patent No.: US 10,183,487 B2
(45) Date of Patent: Jan. 22, 2019

(54) LIQUID DISCHARGE APPARATUS

(71) Applicant: BROTHER KOGYO KABUSHIKI KAISHA, Nagoya-shi, Aichi-ken (JP)

(72) Inventors: Takashi Kanzaki, Nagoya (JP); Kazunari Matsuura, Komaki (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/925,101

(22) Filed: Mar. 19, 2018

(65) Prior Publication Data

US 2018/0281393 A1 Oct. 4, 2018

(30) Foreign Application Priority Data

Mar. 31, 2017 (JP) ..... 2017-073164

(51) Int. Cl.
*B41J 2/045* (2006.01)
*B41J 2/145* (2006.01)

(52) U.S. Cl.
CPC ..... *B41J 2/04586* (2013.01); *B41J 2/04505* (2013.01); *B41J 2/145* (2013.01)

(58) Field of Classification Search
CPC ..... B41J 2/2132; B41J 2/145; B41J 2/0458; B41J 2/04505; B41J 2/04586; B41J 2/04573; B41J 29/38
(Continued)

(56) References Cited

U.S. PATENT DOCUMENTS 7,264,324 B2 * 9/2007 Kovacs ..... B41J 2/2135 347/12
7,434,909 B2 * 10/2008 Suzuki ..... B41J 2/155 347/40

(Continued)

FOREIGN PATENT DOCUMENTS

JP 2002-254649 A 9/2002
JP 2005-169628 A 6/2005

*Primary Examiner* — Jannelle M Lebron
(74) *Attorney, Agent, or Firm* — Merchant & Gould P.C.

(57) ABSTRACT

There is provided a liquid discharge apparatus including: first and second liquid discharge heads and a controller. The first liquid discharge head includes n of nozzles $NA_1$-$NA_n$ and m of nozzles $NB_1$-$NB_m$. The second liquid discharge head includes m of nozzles $NC_1$-$NC_m$. The first and second liquid discharge heads include m of nozzle pairs ($NB_1$, $NC_1$)-($NB_m$, $NC_m$) A difference of position between the nozzle $NB_j$ and the nozzle $NC_j$ in the first direction is smallest in the j-th nozzle pair ($NB_j$, $NC_j$), of them of nozzle pairs ($NB_1$, $NC_1$)-($NB_m$, $NC_m$), and a difference between the use rate $RB_p$ of the nozzle $NB_p$ and the use rate $RC_p$ of the nozzle $NC_p$ is smallest in the p-th nozzle pair ($NB_p$, $NC_p$) different from the j-th nozzle pair ($NB_j$, $NC_j$), of the m of nozzle pairs ($NB_1$, $NC_1$)-($NB_m$, $NC_m$).

10 Claims, 13 Drawing Sheets

(58) Field of Classification Search
USPC ..... 347/9, 12, 40, 54
See application file for complete search history.

(56) References Cited

U.S. PATENT DOCUMENTS

| | | | |
|---|---|---|---|
| 2002/0140769 | A1 | 10/2002 | Kuwahara |
| 2005/0122354 | A1 | 6/2005 | Yamane et al. |

* cited by examiner

CASE THERE IS NO POSITIONAL SHIFT OF IMPACT

CASE THERE IS POSITIONAL SHIFT OF IMPACT

LIQUID DISCHARGE APPARATUS

CROSS REFERENCE TO RELATED APPLICATION

The present application claims priority from Japanese Patent Application No. 2017-073164, filed on Mar. 31, 2017, the disclosure of which is incorporated herein by reference in its entirety.

BACKGROUND

Field of the Invention

The present teaching relates to a liquid discharge apparatus that discharges a liquid such as ink toward a medium.

Description of the Related Art

As an example of a liquid discharge apparatus, there is known an ink-jet printer that includes an ink-jet head. For example, there is known an ink-jet printer including an ink-jet head, in which the ink-jet head has a plurality of head units lined up in a width direction of a recording medium such as a recording sheet.

In such an ink-jet head, if positions of nozzles of two head chips are greatly misaligned in a joining portion of two head units adjacent in the width direction, a white stripe or a black stripe easily occurs in an image formed by the above-described joining portion. Accordingly, in the past, various techniques for suppressing the above-described white stripe or black stripe have been proposed.

For example, a known ink-jet head has a plurality of head chips lined up in two columns. Each of the columns of head chips extends so as to extend in a left-right direction, and the two columns of head chips are disposed so as to be lined up in a front-rear direction orthogonal to the left-right direction. Note that the two columns of head chips are disposed out of alignment in the left-right direction, so that each of the head chips is lined up in a zigzag manner. A left end section of each of the head chips configuring one of the columns of head chips is lined up in the front-rear direction with a right end section of one of the head chips configuring the other of the columns of head chips. A right end section of each of the head chips configuring one of the columns of head chips is lined up in the front-rear direction with a left end section of one of the head chips configuring the other of the columns of head chips. In the known ink-jet head described above, such a portion where two chip heads are lined up in the front-rear direction is called an overlap section.

SUMMARY

An object of the present teaching is to provide a liquid discharge apparatus in which printing quality is good in the case that the liquid discharge apparatus has an overlap section where two head chips are lined up in a front-rear direction.

According to an aspect of the present teaching, there is provided a liquid discharge apparatus configured to discharge droplets of liquid onto a medium, including: a first liquid discharge head, a second liquid discharge head and a controller configured to control the first liquid discharge head and the second liquid discharge head. The first liquid discharge head includes: a first end; a second end separated from the first end in a first direction; n of nozzles $NA_1$-$NA_n$ located between the first end and the second end in the first direction, and aligned in the first direction with a first pitch from the first end toward the second end; and m of nozzles $NB_1$-$NB_m$ located between the nozzle $NA_n$ and the second end in the first direction and aligned in the first direction from the nozzle $NA_n$ toward the second end with a second pitch different from the first pitch. The second liquid discharge head is aligned with the first liquid discharge head in a second direction orthogonal to the first direction, and includes: a third end; a fourth end separated from the third end in the first direction; m of nozzles $NC_1$-$NC_m$ located between the third end and the fourth end in the first direction, and aligned in the first direction from the third end toward the fourth end with the first pitch. The first and second liquid discharge heads include m of nozzle pairs ($NB_1$, $NC_1$)-($NB_m$, $NC_m$). The controller is configured to cooperatively form a dot array extending in the second direction, on the medium moving in the second direction relatively to the first and second liquid discharge heads, for each of the m of nozzle pairs ($NB_1$, $NC_1$)-($NB_m$, $NC_m$). In a case of cooperatively forming the dot array extending in the second direction on the medium moving in the second direction relatively to the first and second liquid discharge heads, the controller is configured to control the first liquid discharge head and the second liquid discharge head to discharge droplets from the nozzle $NB_i$ at a use rate $RB_i$ and discharge droplets from the nozzle $NC_i$ at a use rate $RC_i$, by the i-th ($1 \leq i \leq m$) nozzle pair ($NB_i$, $NC_i$). A difference of position between the nozzle $NB_j$ and the nozzle $NC_j$ in the first direction is smallest in the j-th nozzle pair ($NB_j$, $NC_j$), of the m of nozzle pairs ($NB_1$, $NC_1$)-($NB_m$, $NC_m$). A difference between the use rate $RB_p$ of the nozzle $NB_p$ and the use rate $RC_p$ of the nozzle $NC_p$ is smallest in the p-th nozzle pair ($NB_p$, $NC_p$) different from the j-th nozzle pair ($NB_j$, $NC_j$), of them of nozzle pairs ($NB_1$, $NC_1$)-($NB_m$, $NC_m$).

In the above-described configuration, a difference between a use rate RB of a nozzle NB and a use rate RC of a nozzle NC is made smallest in a separate nozzle pair (a secondary nozzle pair) which is not a primary nozzle pair ($NB_p$, $NC_p$) in which positions coincide in a first direction. This makes it possible to suppress a lowering of printing quality due to a positional shift of impact occurring after start of droplet discharge.

DESCRIPTION OF THE EMBODIMENTS

Figure 1:
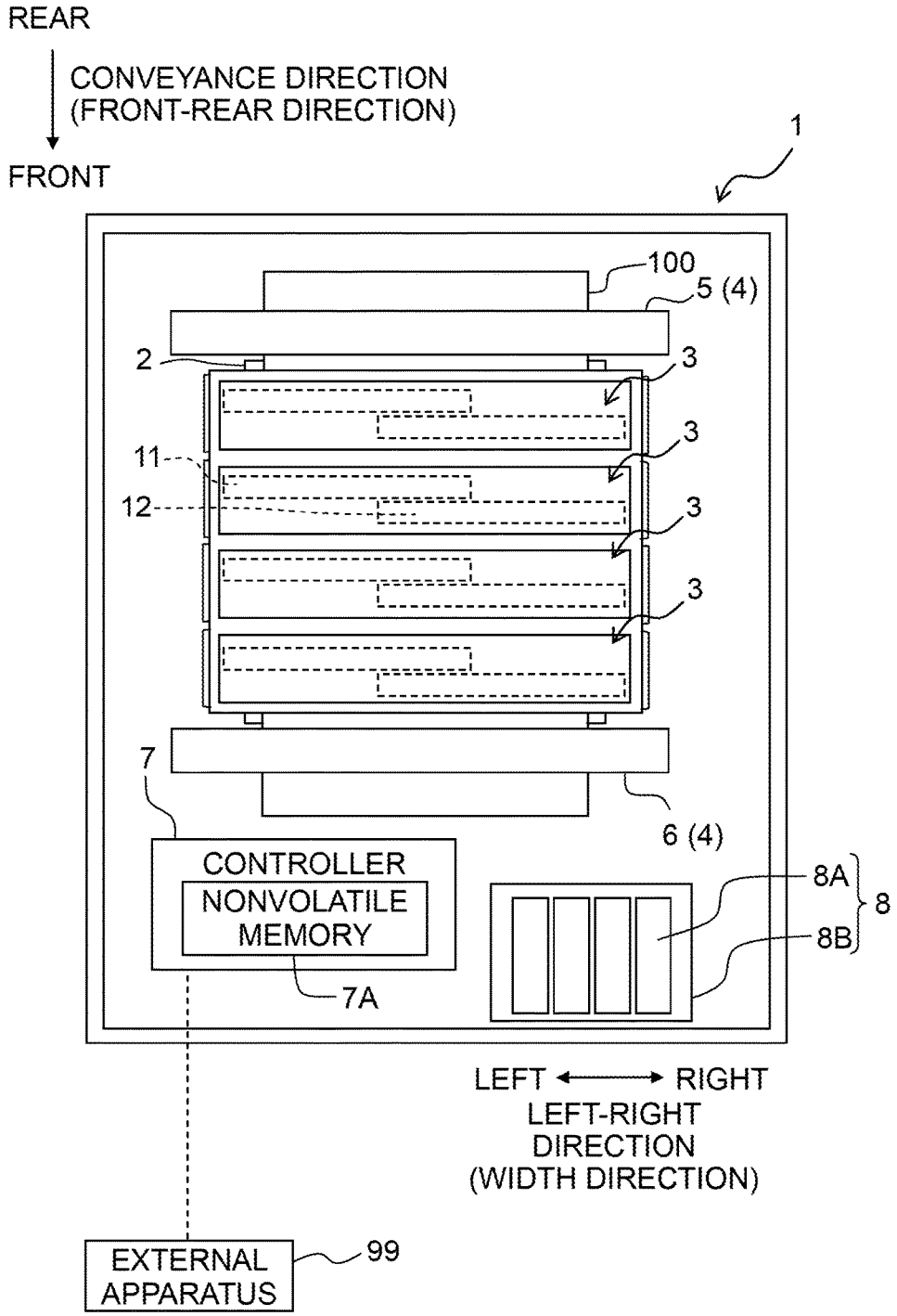
FIG. 1 is a plan view showing an outline of an ink-jet printer 1 according to the present embodiment.

An embodiment of the present teaching will be described. FIG. 1 is a plan view showing an outline of an ink-jet printer 1 according to the present embodiment. Each of directions of front, rear, left, and right shown in FIG. 1 are defined as "front", "rear", "left", and "right" of the ink-jet printer 1. Moreover, this side of the paper surface is defined as "up", and the far side of the paper surface is defined as "down".

As shown in FIG. 1, the ink-jet printer 1 mainly includes a platen 2, four ink-jet heads 3, a conveyance mechanism 4, a controller 7, and an ink supply unit 8.

A recording sheet 100 which is a recording medium is placed on an upper surface of the platen 2. The ink supply unit 8 includes: four ink cartridges 8A in which inks of four colors (black, yellow, cyan, magenta) have been respectively stored; a cartridge holder 8B fitted with the four ink cartridges; and unillustrated tubes. The four ink-jet heads 3 and the four ink cartridges 8A are respectively connected via the unillustrated tubes. As a result, the inks of the four colors are supplied from the ink supply unit 8 to the four ink-jet heads 3. By configuring in this way, the ink-jet heads 3 are each supplied with any one of the inks of the four colors (black, yellow, cyan, magenta), so that the ink-jet heads 3 discharge inks of mutually differing colors.

The conveyance mechanism 4 has two conveyance rollers 5, 6 disposed so as to sandwich the platen 2 in a front-rear direction. The conveyance mechanism 4 conveys the recording sheet 100 placed on the platen 2 frontwards by the two conveyance rollers 5, 6 and an unillustrated motor transmitting power to the two conveyance rollers 5, 6. Note that in the description below, the front-rear direction is also referred to as a conveyance direction. Moreover, a left-right direction is also referred to as a width direction of the recording sheet 100.

The controller 7 includes the likes of a ROM (Read Only Memory), a RAM (Random Access Memory), and an ASIC (Application Specific Integrated Circuit). Furthermore, the controller 7 includes a nonvolatile memory 7A that rewritably stores a control parameter. The nonvolatile memory 7A stores the likes of later-mentioned mask data. The controller 7 executes various kinds of processing, such as printing, on the recording sheet 100, by the ASIC, according to a program stored in the ROM. For example, in a printing processing, the controller 7 controls the likes of the ink-jet head 3 or conveyance mechanism 4 to print an image on the recording sheet 100, based on a printing instruction and image data inputted from an external apparatus 99 such as a PC. Specifically, the controller 7 causes simultaneous execution of a conveyance operation that conveys the recording sheet 100 in the conveyance direction at a certain conveyance speed by the conveyance rollers 5, 6 and an ink discharge operation that discharges ink from the ink-jet head 3 onto the recording sheet 100 conveyed at the certain speed. Alternatively, the controller 7 may cause alternate execution of a conveyance operation that conveys a certain conveyance amount only of the recording sheet 100 in the conveyance direction by the conveyance rollers 5, 6 and an ink discharge operation that discharges ink from the ink-jet head 3 onto the conveyed recording sheet 100.

Next, a configuration of the ink-jet head 3 will be described. Note that since the four ink-jet heads 3 all have the same configuration excluding that colors of the discharged inks differ, a description of one of those four ink-jet heads 3 will be made, and descriptions of the other ink-jet heads 3 will be omitted.

Figure 2:
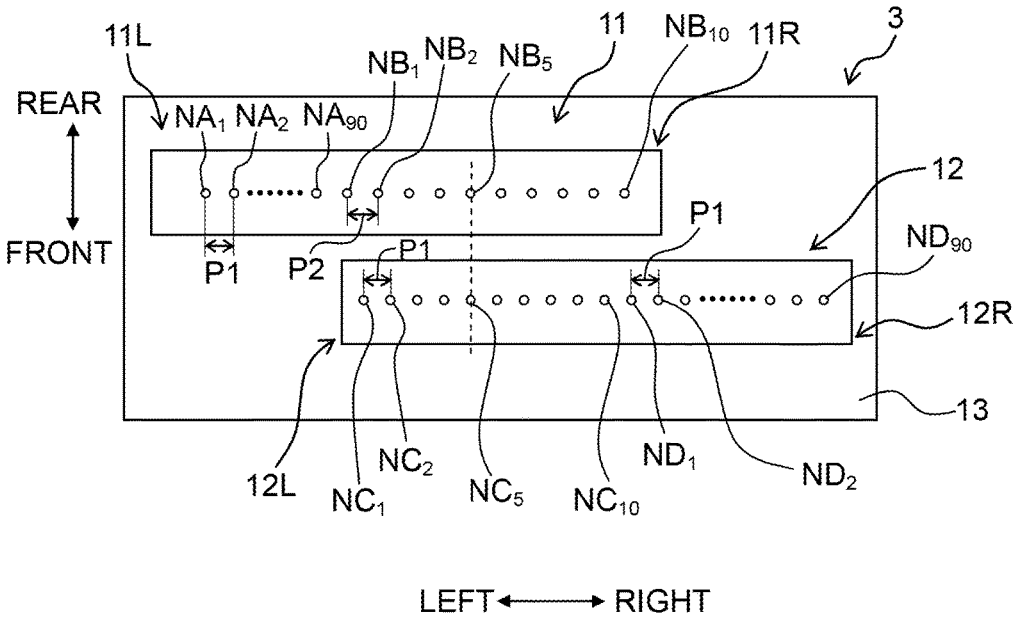
FIG. 2 is a schematic plan view of an ink-jet head 3.

The ink-jet head 3 includes: two head chips (head chip 11, head chip 12); and a chip holding plate 13 that holds the head chip 11 and the head chip 12. As shown in FIG. 2, the head chip 11 has a left end section 11L and a right end section 11R in the left-right direction. The head chip 11 and the head chip 12 are disposed out of alignment in the front-rear direction, in the conveyance direction. The head chip 12 has a left end section 12L and a right end section 12R in the left-right direction. The left end section 11L and the right end section 11R of the head chip 11 are each positioned more to a rear side than the left end section 12L and the right end section 12R of the head chip 12, in the conveyance direction (the front-rear direction). The right end section 11R of the head chip 11 is positioned between the left end section 12L and the right end section 12R of the head chip 12 in the left-right direction. The left end section 12L of the head chip 12 is positioned between the left end section 11L and the right end section 11R of the head chip 11 in the left-right direction.

Next, an arrangement of nozzles formed in the head chip 11 and the head chip 12 will be described. Note that as an example here, the head chip 11 and the head chip 12 will be described assuming them to have 100 nozzles.

The head chip 11 has: 90 nozzles NA (nozzles $NA_1$-$NA_{90}$) lined up in the left-right direction with a certain pitch P1; and 10 nozzles NB (nozzles $NB_1$-$NB_{10}$) lined up in the left-right direction with a pitch P2 which is broader than the pitch P1. The 90 nozzles NA are lined up in order of nozzle $NA_1$-nozzle $NA_{90}$ from the left end section 11L toward the right end section 11R. The 10 nozzles NB are lined up in order of nozzle $NB_1$-nozzle $NB_{10}$ from the left end section 11L toward the right end section 11R. The nozzle $NA_{90}$ and the nozzle $NB_1$ are lined up so as to be adjacent in the left-right direction, and a spacing between the nozzle $NA_{90}$ and the nozzle $NB_1$ is equal to the pitch P1.

The head chip 12 has: 10 nozzles NC (nozzles $NC_1$-$NC_{10}$) lined up in the left-right direction with the pitch P1; and 90 nozzles ND (nozzles $ND_1$-$ND_{90}$) lined up in the left-right direction in the same way with the pitch P1. The 10 nozzles NC are lined up in order of nozzle $NC_1$-nozzle $NC_{10}$ from the left end section 12L toward the right end section 12R. The 90 nozzles ND are lined up in order of nozzle $ND_1$-nozzle $ND_{90}$ from the left end section 12L toward the right end section 12R. The nozzle $NC_{10}$ and the nozzle $ND_1$ are lined up so as to be adjacent in the left-right direction, and a spacing between the nozzle $NC_{10}$ and the nozzle $ND_1$ is equal to the pitch P1.

The nozzles $NB_1$-$NB_{10}$ of the head chip 11 and the nozzles $NC_1$-$NC_{10}$ of the head chip 12 are lined up in the front-rear direction. Moreover, as will be mentioned later, the nozzle $NB_1$ and the nozzle $NC_1$ configure a nozzle pair configured so as to cooperatively form a dot array of the same row. Similarly, the nozzles $NB_2$-$NB_{10}$ also respectively configure nozzle pairs with the nozzles $NC_2$-$NC_{10}$ . Note that in the description below, each of the nozzle pairs is notated in a manner of ($NB_1$, $NC_1$).

The nozzles $NB_1$-$NB_{10}$ lined up with the pitch P2 which is larger than the pitch P1 and the nozzles $NC_1$-$NC_{10}$ lined up with the pitch P1 configure 10 nozzle pairs, and are configured so as to cooperatively form dot arrays of same rows. The 90 nozzles NA and the 90 nozzles ND are each configured so as to independently form a dot array of one row. Therefore, the ink-jet head 3 overall is configured so as to form a dot array of 190 rows.

Now, when a difference between the pitch P2 and the pitch P1 is large, that difference ends up being visually recognized even if it is attempted to form a dot array of the same row. Therefore, the difference between the pitch P2 and the pitch P1 is preferably not more than a certain amount. For example, the difference between the pitch P2 and the pitch P1 is preferably not more than ¼ of the pitch P1. If resolution of the ink-jet head is assumed to be 600 dpi, then the pitch P1 will be 42 μm. In this case, the difference between the pitch P2 and the pitch P1 may be set to 10 μm or less.

In the present embodiment, the pitch P1 is set to 42 and the pitch P2 is set to 46.6 μm. At this time, the difference between the pitch P2 and the pitch P1 will be 4.6 μm. A distance in the left-right direction between the nozzles NB and the nozzles NC belonging to each of the nozzle pairs changes 4.6 μm at a time among the 10 nozzle pairs ($NB_1$, $NC_1$)-($NB_{10}$, $NC_{10}$). Therefore, in the 10 nozzle pairs overall, a shift of 4.6×9=41.4 μm occurs, and this shift amount will be substantially the same as the pitch P1.

When the head chip 11 and the head chip 12 are disposed in the chip holding plate 13, they are disposed with a rough positioning so that positions in the left-right direction of the fifth nozzle $NB_5$ and the fifth nozzle $NC_5$ substantially coincide. At this time, positioning can preferably be performed with a precision such as will prevent the positions in the left-right direction of the fifth nozzle $NB_5$ and the fifth nozzle $NC_5$ from being out of alignment by 42 μm or more. As described above, because the nozzles NB and the nozzles NC are arranged with slightly differing pitches, it results in the distances in the left-right direction between the nozzles NB and the nozzles NC configuring each of the nozzle pairs slightly differing from each other in each of the nozzle pairs ($NB_1$, $NC_1$)-($NB_{10}$, $NC_{10}$). In any one of the 10 nozzle pairs ($NB_1$, $NC_1$)-($NB_{10}$, $NC_{10}$), the positions in the left-right direction of the nozzle NB and the nozzle NC will be substantially the same. In other words, in any one of the 10 nozzle pairs ($NB_1$, $NC_1$)-($NB_{10}$, $NC_{10}$), the positional shift in the left-right direction of the nozzle NB and the nozzle NC will be in a permissible difference range. In the description below, such a nozzle pair will be called a primary nozzle pair.

As will be mentioned later, which nozzle pair of the 10 nozzle pairs represents the primary nozzle pair is specified by a test during manufacturing of the ink-jet head 3, and later-mentioned mask data based on a result of the test is stored in the nonvolatile memory 7A. In the description below, the fifth from left nozzle pair ($NB_5$, $NC_5$) is assumed to be the primary nozzle pair.

Next, discharge control of the ink-jet head 3 will be described with reference to FIG. 3.

Figure 3:
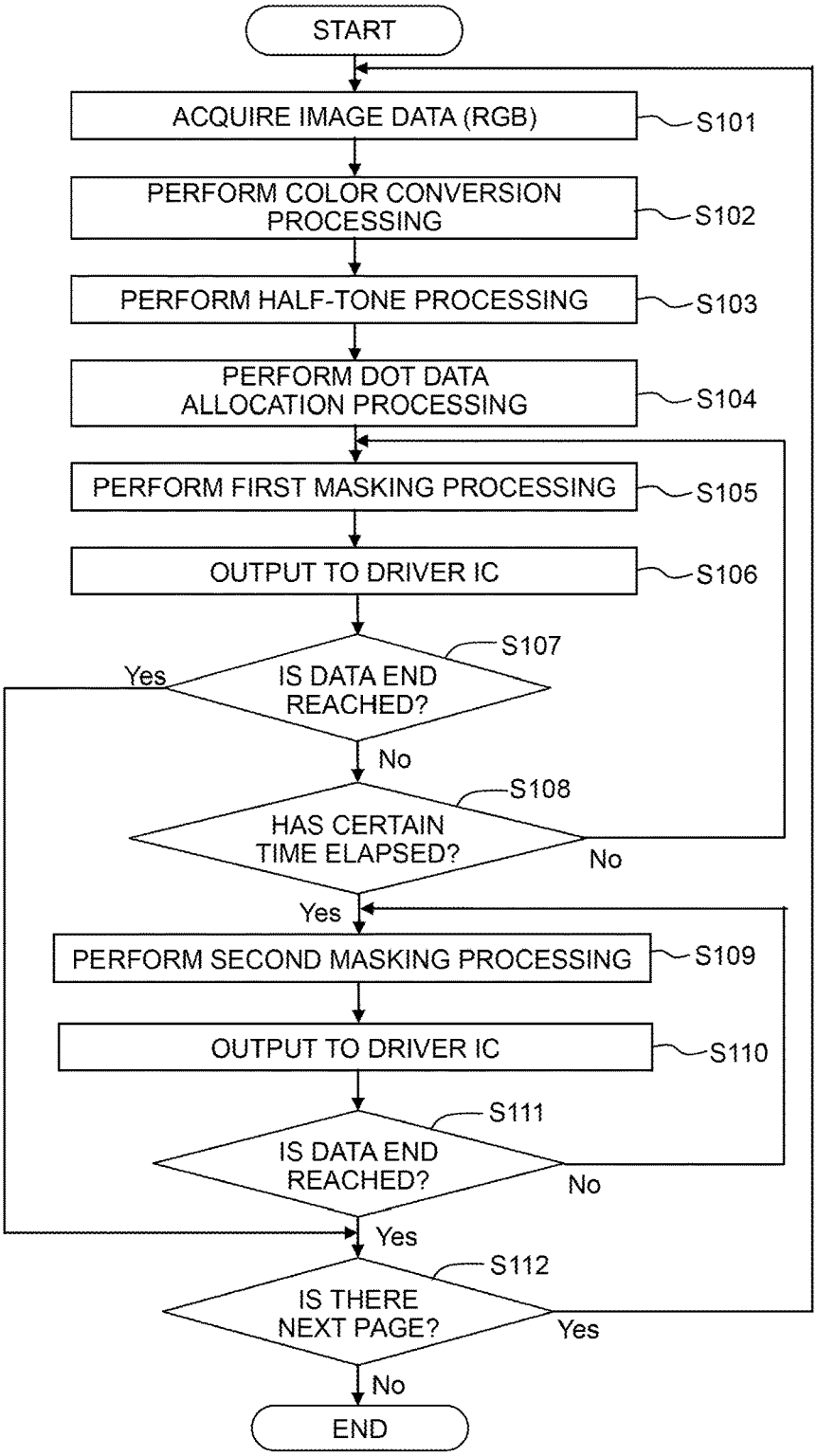
FIG. 3 is a flowchart showing discharge control of the ink-jet head 3.

As shown in FIG. 3, when a printing instruction has been inputted from the external apparatus 99, the controller 7 acquires image data of a one page portion of the recording sheet 100 from the external apparatus 99 (S101). The image data is RGB format image data including three kinds of color-distinguished image data respectively corresponding to RGB. Each of the color-distinguished image data is configured from a plurality of pixel data of a pixel number matched to resolution of the ink-jet printer 1. Each of the pixel data is data of 256 gradations that shows a gradation value of color respectively corresponding to each of the pixel data.

Next, the controller 7 performs color conversion processing that converts the above-mentioned RGB color-distinguished image data of the one page portion of the recording sheet 100 into CMYK format image data corresponding to the four ink colors of cyan (C), magenta (M), yellow (Y), and black (K) (S102). The CMYK format image data includes four kinds of color-distinguished image data respectively corresponding to CMYK. The four kinds of color-distinguished image data are each configured from a plurality of pixel data of a pixel number matched to resolution of the ink-jet printer 1. Each of the pixel data is data of 256 gradations that shows a gradation value of color respectively corresponding to each of the pixel data. Conversion from the RGB format image data to the CMYK format image data can be performed using, for example, a look-up table in which a correspondence relationship between representative values of RGB gradation values and CMYK gradation values is recorded.

Next, the controller 7 performs half-tone processing on the CMYK format image data of the one page portion of the recording sheet 100 and generates dot data indicating presence/absence of formation of a dot in each of the pixels corresponding to the ink colors of CMYK (S103). The dot data includes four kinds of color-distinguished dot data corresponding to the four colors of CMYK. The four kinds of color-distinguished dot data (dot data DC, dot data DM, dot data DY, and dot data DK) are each configured from a plurality of pixel data of a pixel number matched to resolution of the ink-jet printer 1. Each of the pixel data respectively includes binary data indicating presence/absence of formation of a dot. Note that data conversion in the half-tone processing may adopt a publicly known technique such as an error diffusion method, a dither method, or the like.

Figure 4:
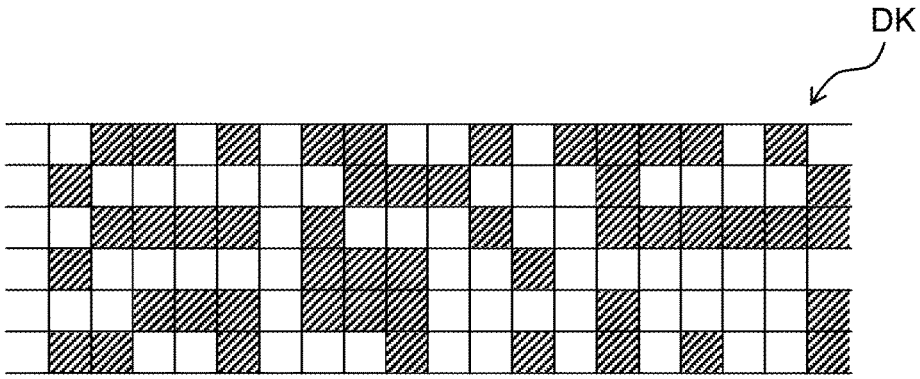
FIG. 4 is an example of dot data.

FIG. 4 shows an example of dot data. The dot data DK shown in FIG. 4 is black dot data, and shows only a partial section of a 20 item portion in the left-right direction and a six column portion in the front-rear direction. In FIG. 4, a blank cell schematically shows pixel data indicating that ink is not to be discharged, and a black cell schematically expresses pixel data where ink is to be discharged.

Next, the controller 7 allocates the four kinds of color-distinguished dot data to the two head chips 11, 12 of the four ink-jet heads 3 corresponding to each of the colors (S104). Note that in the description below, although description is made exemplifying one of the four colors of inks (for example, black), the same applies also to the other inks.

Now, the controller 7 processes the color-distinguished dot data generated in step S103 to generate color-distinguished dot data for head chip 11 and color-distinguished dot data for head chip 12. Specifically, the controller 7 extracts the first to hundredth pixel data counting from furthest left in the left-right direction, of the color-distinguished dot data generated in step S103 to generate the color-distinguished dot data for head chip 11. The first to ninetieth pixel data from left, of the color-distinguished dot data for head chip 11 corresponds to the nozzles $NA_1$-$NA_{90}$, and the ninety-first to hundredth pixel data from left, of the color-distinguished dot data for head chip 11 corresponds to the nozzles $NB_1$-$NB_{10}$.

Similarly, the controller 7 extracts the ninety-first to hundred-and-ninetieth pixel data counting from furthest left in the left-right direction, of the color-distinguished dot data generated in step S103 to generate the color-distinguished dot data for head chip 12. The first to tenth pixel data from left, of the color-distinguished dot data for head chip 12 corresponds to the nozzles $NC_1$-$NC_{10}$, and the eleventh to hundredth pixel data from left, of the color-distinguished dot data for head chip 12 corresponds to the nozzles $ND_1$-$ND_{90}$.

Mask data MA and mask data MB are stored in the nonvolatile memory 7A of the controller 7. As will be mentioned later, mask data MA, MB are data for masking the dot data to process the dot data into discharge data.

The mask data MA includes mask data MA1 for head chip 11 and mask data MA2 for head chip 12. The mask data MB includes mask data MB1 for head chip 11 and mask data MB2 for head chip 12.

Figure 5:
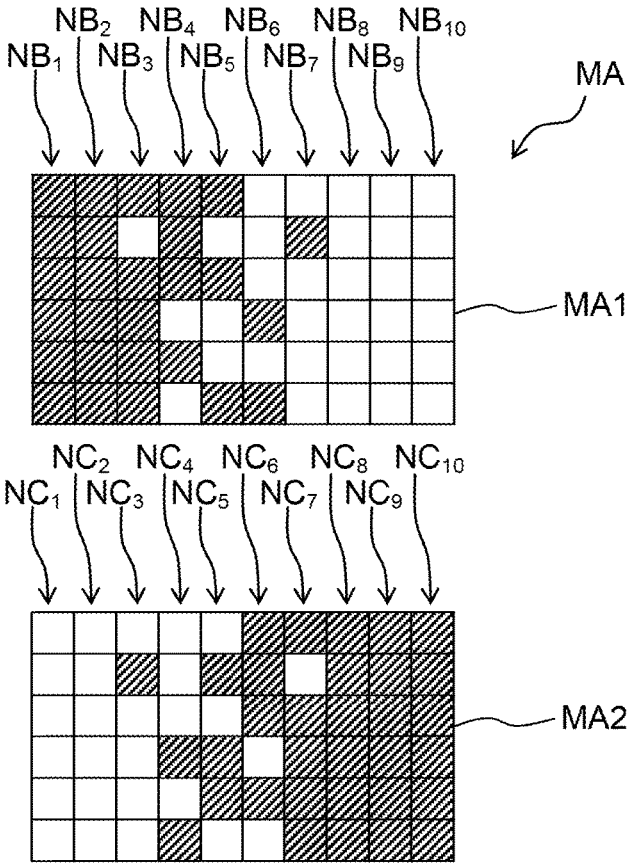
FIG. 5 is an example of first mask data MA.

For example, the mask data MA has the mask data MA1 for head chip 11 and the mask data MA2 for head chip 12 of the kind shown in FIG. 5. Although FIG. 5 only shows a six row portion, the mask data MA is configured as a certain-number-of-rows portion of mask data. Note that in FIG. 5, since all of a portion corresponding to the nozzles $NA_1$-$NA_{90}$ of the mask data MA1 corresponds to blank cells, illustration of that portion is omitted, and only a portion corresponding to the nozzles $NB_1$-$NB_{10}$of the mask data MA1 is illustrated. Similarly, illustration of a portion corresponding to the nozzles $ND_1$-$ND_{90}$ of the mask data MA2 is omitted, and only a portion corresponding to the nozzles $NC_1$-$NC_{10}$ of the mask data MA2 is illustrated. The black cells of FIG. 5 indicate data permitting discharge of ink, and the blank cells of FIG. 5 indicate data not permitting discharge of ink.

Figure 6:
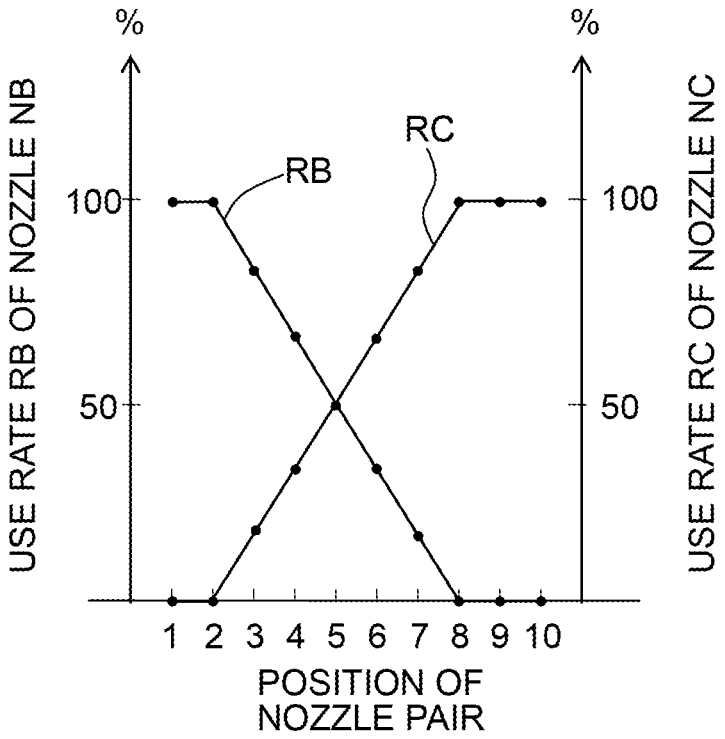
FIG. 6 is a graph showing a use rate RB of a nozzle NB and a use rate RC of a nozzle NC in each of nozzle pairs when employing the first mask data MA.

As shown in FIG. 6, the mask data MA1 is set so that a use rate $RB_5$ of the nozzle $NB_5$ will be 50%, corresponding to how positions in the left-right direction of the nozzle $NB_5$ and the nozzle $NC_5$ of the fifth nozzle pair are substantially the same. The mask data MA2 is set so that a use rate $RC_5$ of the nozzle $NC_5$ will be 50%, corresponding to how positions in the left-right direction of the nozzle $NB_5$ and the nozzle $NC_5$ of the fifth nozzle pair are substantially the same. Now, the use rate RB of the nozzle NB indicates a proportion that discharge of ink from the nozzle NB is permitted, in the mask data MA1. Similarly, the use rate RC of the nozzle NC indicates a proportion that discharge of ink from the nozzle NC is permitted, in the mask data MA2.

Setting is made so that a use rate $RB_4$ of the nozzle NB of the fourth nozzle pair ($NB_4$, $NC_4$) and a use rate $RC_6$ of the nozzle NC of the sixth nozzle pair ($NB_6$, $NC_6$) will both be 66.7%, and so that a use rate $RC_4$ of the nozzle NC of the fourth nozzle pair ($NB_4$, $NC_4$) and a use rate $RB_6$ of the nozzle NB of the sixth nozzle pair ($NB_6$, $NC_6$) will both be 33.3%. In addition, setting is made so that a use rate $RB_3$ of the nozzle NB of the third nozzle pair ($NB_3$, $NC_3$) and a use rate $RC_7$ of the nozzle NC of the seventh nozzle pair ($NB_7$, $NC_7$) will both be 83.3%, and so that a use rate $RC_3$ of the nozzle NC of the third nozzle pair ($NB_3$, $NC_3$) and a use rate $RB_7$ of the nozzle NB of the seventh nozzle pair ($NB_7$, $NC_7$) will both be 16.7%. Furthermore, setting is made so that the use rates RB of the nozzles NB of the first and second nozzle pairs and the use rates RC of the nozzles NC of the eighth to tenth nozzle pairs will all be 100%, and so that the use rates RC of the nozzles NC of the first and second nozzle pairs and the use rates RB of the nozzles NB of the eighth to tenth nozzle pairs will all be 0%.

The controller 7 performs a certain-number-of-rows portion of masking processing on the dot data generated in step S103 and generates discharge data for head chip 11 and discharge data for head chip 12, based on such mask data MA (first masking processing; S105). Note that after manufacturing of the ink-jet printer 1, the ink-jet printer 1 undergoes a test that finds out which nozzle pair of the ten nozzle pairs ($NB_1$, $NC_1$)-($NB_{10}$, $NC_{10}$) has positions of its nozzle pair configured closest in the left-right direction, whereby the primary nozzle pair is determined. Moreover, based on a position of the primary nozzle pair, appropriate mask data is stored in the nonvolatile memory 7A of the ink-jet printer 1 as the mask data MA.

After the discharge data for head chip 11 and the discharge data for head chip 12 has been generated, the controller 7 outputs the discharge data for head chip 11 to a driver IC for head chip 11 (not illustrated), and outputs the discharge data for head chip 12 to a driver IC for head chip 12 (not illustrated) (S106). The driver IC for head chip 11 generates a drive signal for driving the likes of a piezoelectric element provided corresponding to each of nozzles of the head chip 11, based on the discharge data for head chip 11, and outputs the drive signal. Similarly, the driver IC for head chip 12 generates a drive signal for driving the likes of a piezoelectric element provided corresponding to each of nozzles of the head chip 12, based on the discharge data for head chip 12, and outputs the drive signal.

The controller 7 judges whether an end of the dot data of the one page portion of the recording sheet has been reached (S107). In the case that data end has been reached (S107: Yes), it is confirmed whether there is a next page (S112). In the case that there is a next page (S112: Yes), processing is returned to step S101, whereby image data of the next page is acquired. In the case that there is not a next page (S112: No), processing is finished.

In the case that data end has not been reached (S107: No), it is judged whether an elapsed time after acquiring the image data of the one page portion of the sheet is exceeding a certain time (S108). In the case that the certain time is not being exceeded (S108: No), processing is returned to before step S105, and similar processing (S105-S106) is repeated for the next certain-number-of-rows portion of dot data.

In the case that the certain time is being exceeded (S108: Yes), the controller 7 selects the mask data MB in place of the above-described mask data MA.

Figure 7:
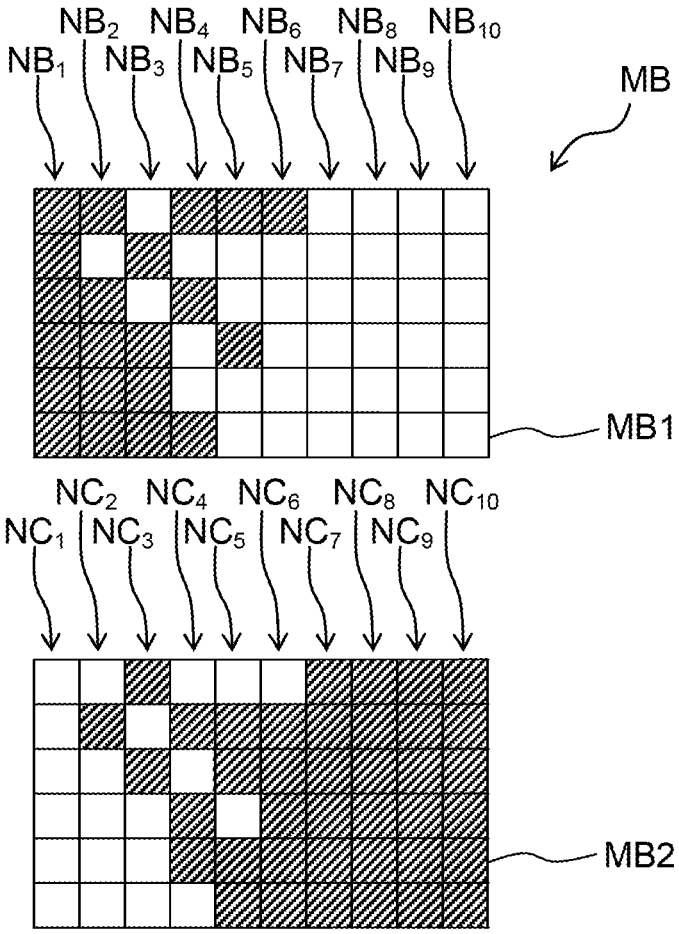
FIG. 7 is an example of second mask data MB.

The mask data MB has the mask data MB1 for head chip 11 and the mask data MB2 for head chip 12 of the kind shown in FIG. 7. Although FIG. 7 only shows a six row portion, the mask data MB is configured as a certain-number-of-rows portion of mask data. Note that in FIG. 7, similarly to in FIG. 5, only a portion corresponding to the nozzles $NB_1$ -$NB_{10}$ of the mask data MB1 and a portion corresponding to the nozzles $NC_1$-$NC_{10}$ of the mask data MB2, are illustrated. The black cells of FIG. 7 indicate data permitting discharge of ink, and the blank cells of FIG. 7 indicate data not permitting discharge of ink.

Figure 8:
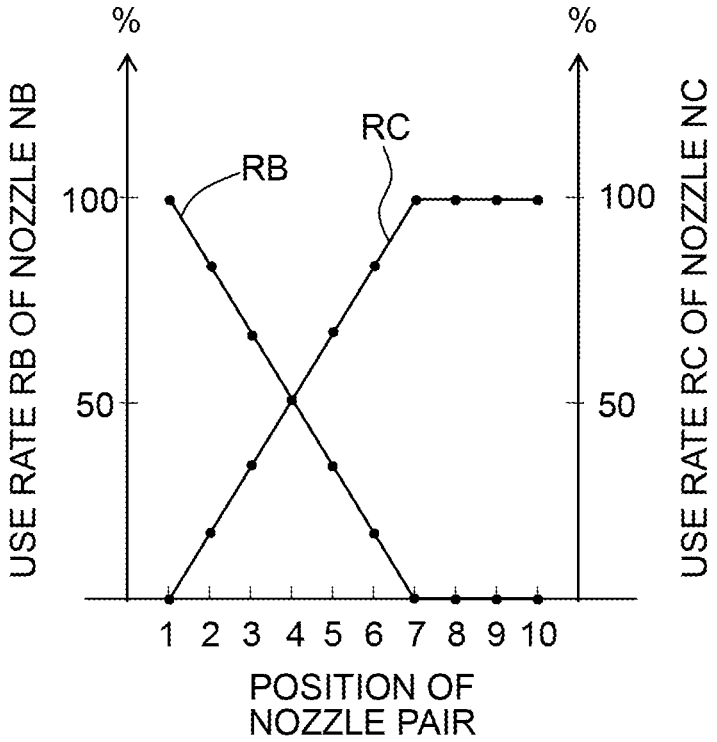
FIG. 8 is a graph showing the use rate RB of the nozzle NB and the use rate RC of the nozzle NC in each of the nozzle pairs when employing the second mask data MB.

As shown in FIG. 8, setting is made so that the use rate $RB_4$ of the nozzle $NB_4$ of the fourth nozzle pair (a secondary nozzle pair) will be 49.5% and so that the use rate $RC_4$ of the nozzle $NC_4$ of the fourth nozzle pair will be 50.5%. Moreover, setting is made so that the use rate $RB_3$ of the nozzle $NB_3$ of the third nozzle pair ($NB_3$, $NC_3$) will be 66.2%, so that the use rate $RC_5$ of the nozzle $NC_5$ of the fifth nozzle pair ($NB_5$, $NC_5$) will be 65.2%, so that the use rate $RC_3$ of the nozzle $NC_3$ of the third nozzle pair ($NB_3$, $NC_3$) will be 32.8%, and so that the use rate $RB_5$ of the nozzle $NB_5$ of the fifth nozzle pair ($NB_5$, $NC_5$) will be 33.8%. In addition, setting is made so that the use rate $RB_2$ of the nozzle $NB_2$ of the second nozzle pair ($NB_2$, $NC_2$) will be 87.8%, so that the use rate $RC_6$ of the nozzle $NC_6$ of the sixth nozzle pair ($NB_6$, $NC_6$) will be 86.8%, and so that the use rate $RC_2$ of the nozzle $NC_2$ of the second nozzle pair ($NB_2$, $NC_2$) and the use rate $RB_6$ of the nozzle $NB_6$ of the sixth nozzle pair ($NB_6$, $NC_6$) will both be 16.2%. Furthermore, setting is made so that the use rate $RB_1$ of the nozzle $NB_1$ of the first nozzle pair and the use rates RC of the nozzles NC of the seventh to tenth nozzle pairs will all be 100%, and so that the use rate $RC_1$ of the nozzle $NC_1$ of the first nozzle pair and the use rates RB of the nozzles NB of the seventh to tenth nozzle pairs will all be 0%.

In this way, the mask data MB is set so that in the fourth nozzle pair (the secondary nozzle pair) different from the fifth nozzle pair, a difference between the use rate $RB_4$ of the nozzle $NB_4$ and the use rate $RC_4$ of the nozzle $NC_4$ will be smaller than differences between the use rates RB of the nozzles NB and the use rates RC of the nozzles NC in the other nozzle pairs.

The controller 7 performs masking processing based on the mask data MB and generates discharge data corresponding to the ink-jet head 3 (second masking processing; S109). Subsequently, the controller 7 outputs the discharge data to an unillustrated driver IC of the ink-jet printer 1 (S110).

The controller 7 judges whether an end of the dot data of the one page portion of the recording sheet has been reached (S111). In the case that data end has not been reached (S111: No), processing is returned to before step S109, and similar processing (S109-S110) is repeated for the next certain-number-of-rows portion of dot data. In the case that data end has been reached (S111: Yes), it is confirmed whether there is a next page (S112). In the case that there is a next page (S112: Yes), processing is returned to step S101, whereby image data of the next page is acquired. In the case that there is not a next page (S112: No), processing is finished.

Note that in the above description, when the recording sheet 100 changed from the first page to the second page, a return was made from the mask data MB to the mask data MA. As will be mentioned later, a shift of impact position of ink occurs due to an air current generated in a space where ink droplets fly between a lower surface (a nozzle surface where the nozzles are formed) of the ink-jet head 3 and the recording sheet 100, hence in order to suppress a resultant lowering of printing quality, the mask data MA is changed to the mask data MB. However, when it takes time until printing of the second page starts after printing of the first page of the recording sheet 100 has finished, the air current generated in the space where ink droplets fly between the lower surface (the nozzle surface where the nozzles are formed) of the ink-jet head 3 and the recording sheet 100 is thought to disappear or significantly weaken. Therefore, in the above description, when the recording sheet changed from the first page to the second page, a return was assumed to be made from the mask data MB to the mask data MA. However, when the recording sheet 100 is continuously conveyed whereby printing to the second page begins immediately after printing of the first page of the recording sheet 100 has finished, it is also possible to continue using the mask data MB without returning to the mask data MA in printing of the second page onwards.

In the present embodiment, as mentioned above, the mask data MA and the mask data MB are employed switching between one and the other. In the mask data MA and the mask data MB, positions of the nozzle pair (called the secondary nozzle pair) where a difference in use rate RB of the nozzle RB and use rate RC of the nozzle NC of the nozzle pair is smallest, are different from each other. The reasons for this will be described in detail below.

As mentioned above, in the present embodiment, the fifth nozzle pair ($NB_5$, $NC_5$) was configured as the primary nozzle pair. In other words, positions in the left-right direction of the nozzle $NB_5$ and the nozzle $NC_5$ configuring the fifth nozzle pair ($NB_5$, $NC_5$) coincide in a permissible difference range. Therefore, a positional shift in the left-right direction of the impact position of ink of these nozzles is essentially thought not to occur.

As shown in FIG. 6, in a period up to a certain time lapse after beginning printing on each of the recording sheets 100, the use rate $RB_5$ of the nozzle NB and the use rate $RC_5$ of the nozzle NC of the primary nozzle pair ($NB_5$, $NC_5$) were each set to 50%. Moreover, with increasing separation to the left from the primary nozzle pair, the use rates RB of the nozzles NB of each of the nozzle pairs were gradually made larger than 50%, and proportionately, the use rates RC of the nozzles NC of each of the nozzle pairs were gradually made smaller than 50%. Moreover, in at least the left end nozzle pair ($NB_1$, $NC_1$), the use rate $RB_1$ of the nozzle $NB_1$ was set to 100%, and the use rate $RC_1$ of the nozzle $NC_1$was set to 0%. In addition, with increasing separation to the right from the primary nozzle pair, the use rates RB of the nozzles NB of each of the nozzle pairs were gradually made smaller than 50%, and proportionately, the use rates RC of the nozzles NC of each of the nozzle pairs were gradually made larger than 50%. Moreover, in at least the right end nozzle pair ($NB_{10}$, $NC_{10}$), the use rate $RB_{10}$ of the nozzle $NB_{10}$ was set to 0%, and the use rate $RC_{10}$ of the nozzle $NC_{10}$ was set to 100%.

A region where the above-described 10 nozzle pairs are formed, of the ink-jet head corresponds to an overlap region where a printing region of the head chip 11 and a printing region of the head chip 12 overlap. Now, as mentioned above, in the nine nozzle pairs excluding the above-described primary nozzle pair, of the ink-jet head, the position of the nozzle NB and the position of the nozzle NC differ slightly in the left-right direction. Therefore, in the above-described overlap region, ink discharged from the two head chips can be impacted dispersed. As a result, a join of the printing region of the head chip 11 and the printing region of the head chip 12 can be made inconspicuous.

Furthermore, as mentioned above, in the primary nozzle pair where positions in the left-right direction of the nozzle NB and the nozzle NC coincide, the use rate RB of the nozzle NB and the use rate RC of the nozzle NC are each set to 50%. Moreover, the use rates RB of the nozzles NB and the use rates RC of the nozzles NC are gradually shifted as mentioned above with increasing separation in the left-right direction from the primary nozzle pair. As a result, in all of the nozzle pairs, printing quality can be improved compared to when the use rate RB of the nozzle NB and the use rate RC of the nozzle NC are set to 50%. The reason for this is as below.

Figure 9:
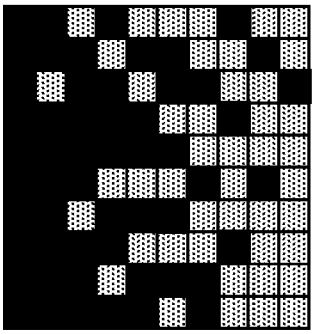
FIG. 9 is a view showing a change in density of a solid coating image when there is positional shift of impact and when there is no positional shift of impact.
Figure 9:
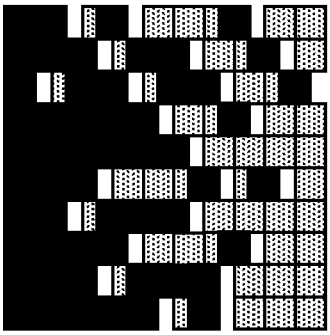

Now, description will be made exemplifying the case where a solid coating image is formed. As shown in FIG. 9, in the case where, for example, a solid coating image is formed in the overlap region, density unevenness caused by a lowering of density of impact ink occurs more when a positional shift of impact has occurred compared to when a positional shift of impact has not occurred at all. In the primary nozzle pair ($NB_5$, $NC_5$), since the positions in the left-right direction of the nozzle $NB_5$ and the nozzle $NC_5$ substantially coincide, the ink discharged from the nozzle $NB_5$ and the ink discharged from the nozzle $NC_5$ impact at substantially the same position in the left-right direction. Therefore, in the primary nozzle pair, when the use rate RB of the nozzle NB and the use rate RC of the nozzle NC are set to 50%, an image of desired density can be obtained. With increasing separation in the left-right direction from the primary nozzle pair, the shift in positions in the left-right direction of the nozzle NB and the nozzle NC configuring the nozzle pair gets larger. Consequently, in a nozzle pair located in a position separated in the left-right direction from the primary nozzle pair, the ink discharged from the nozzle NB and the ink discharged from the nozzle NC impact at positions out of alignment in the left-right direction. In the case that, in the nozzle pair located in a position separated in the left-right direction from the primary nozzle pair, the use rate RB of the nozzle NB and the use rate RC of the nozzle NC are set to 50%, it results in the impact positions of ink ending up dispersing in the left-right direction, whereby the image ends up becoming whitish and density unevenness occurs in the formed solid coating image.

In contrast, as mentioned above, in the case that the difference in the use rates RB of the nozzles NB and the use rates RC of the nozzles NC is gradually made larger with increasing separation in the left-right direction from the primary nozzle pair, dispersion in the left-right direction of impact position of ink can be reduced, so it can be suppressed that the image turns out lower density than a desired density.

Figure 10:
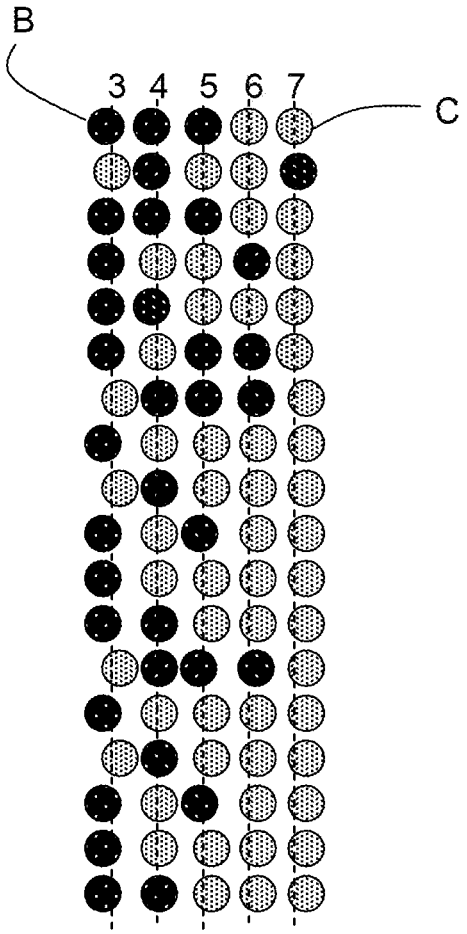
FIG. 10 is a view showing a state of positional shift of impact that has occurred after printing start.

The inventors of the present teaching discovered that even if the use rate RB of the nozzle NB and the use rate RC of the nozzle NC of the primary nozzle pair are each set to 50% and the difference in the use rates RB of the nozzles NB and the use rates RC of the nozzles NC is gradually made larger with increasing separation in the left-right direction from the primary nozzle pair, the following kind of defect occurs. Now, description will be made exemplifying the case of printing a solid coating image configured from a plurality of dot arrays lined up in columns in the conveyance direction. Note that FIG. 10 shows a state of the dot arrays from immediately after start of printing. In FIG. 10, only dots discharged from the third through seventh nozzle pairs are shown. A dot formed by ink discharged from a nozzle NB is shown by a grey dot B, and a dot due to ink discharged from a nozzle NC is shown by a dot C. In the case of forming this kind of pattern of dot arrays, immediately after start of printing, ink discharged from each of the nozzle pairs impacts at certain positions corresponding to positions in the left-right direction of the nozzle NB and the nozzle NC configuring each of the nozzle pairs, in relation to the left-right direction. In particular, ink discharged from the primary nozzle pair in which positions in the left-right direction of the nozzle NB and the nozzle NC coincide, impacts at the same position in the left-right direction. However, a short while after start of printing, a state is reached in which the ink discharged from each of the nozzle pairs impacts at positions slightly out of alignment from the certain positions corresponding to positions in the left-right direction of the nozzle NB and the nozzle NC configuring each of the nozzle pairs, in relation to the left-right direction. Note that the impact position of ink does not necessarily shift only to one of left and right. The impact position sometimes shifts to the left side and sometimes shifts to the right side. When such shift of impact position occurs, a state is reached where even ink discharged from the primary nozzle pair in which positions in the left-right direction of the nozzle NB and the nozzle NC coincide, impacts at a position out of alignment in the left-right direction. As a result, density unevenness ends up occurring in the formed solid coating image.

According to findings of the inventors, it was understood that such positional shift of impact, although not seen immediately after start of printing, gradually increases as time passes from start of printing. Moreover, the positional shift of impact becomes comparatively large in nozzles in a vicinity of end sections of each of the head chips 11, 12.

Due to findings of the inventors, there is understood to be a high possibility that such positional shift of impact occurs due to the air current generated in the space where ink droplets fly between the lower surface (the nozzle surface where the nozzles are formed) of the ink-jet head 3 and the recording sheet 100. Strength of such an air current is thought to be related to relative speed of the recording sheet 100 and the ink-jet head 3, a gap between the lower surface of the ink-jet head 3 and the recording sheet 100 (a print gap), a print duty, and so on.

It was understood that in the present embodiment, positional shift of impact gradually increases as time passes from start of printing because the nozzles NB are disposed in a right side end section of the head chip 11 and the nozzles NC are disposed in a left side end section of the head chip 12.

Accordingly, it was decided that in the present embodiment, up to a certain time elapsing from a printing start time, printing is executed based on the mask data MA, and after the certain time has elapsed, printing is executed based on the mask data MB. Note that the mask data MA and the mask data MB do not necessarily need to be switched based on whether the certain time has elapsed, and that the mask data MA and the mask data MB may be switched based on another condition. For example, the mask data MA and the mask data MB may be switched around a time when printing of a certain number of rows has been performed.

As mentioned above, regarding the mask data MB, in the fourth nozzle pair (the secondary nozzle pair) different from the fifth nozzle pair, the difference of the use rate $RB_4$ of the nozzle NB and the use rate $RC_4$ of the nozzle NC is set so as to be smaller than the differences of the use rates RB of the nozzles NB and the use rates RC of the nozzles NC of other nozzle pairs. Such mask data MB can be prepared based on the following procedure.

Figure 11:
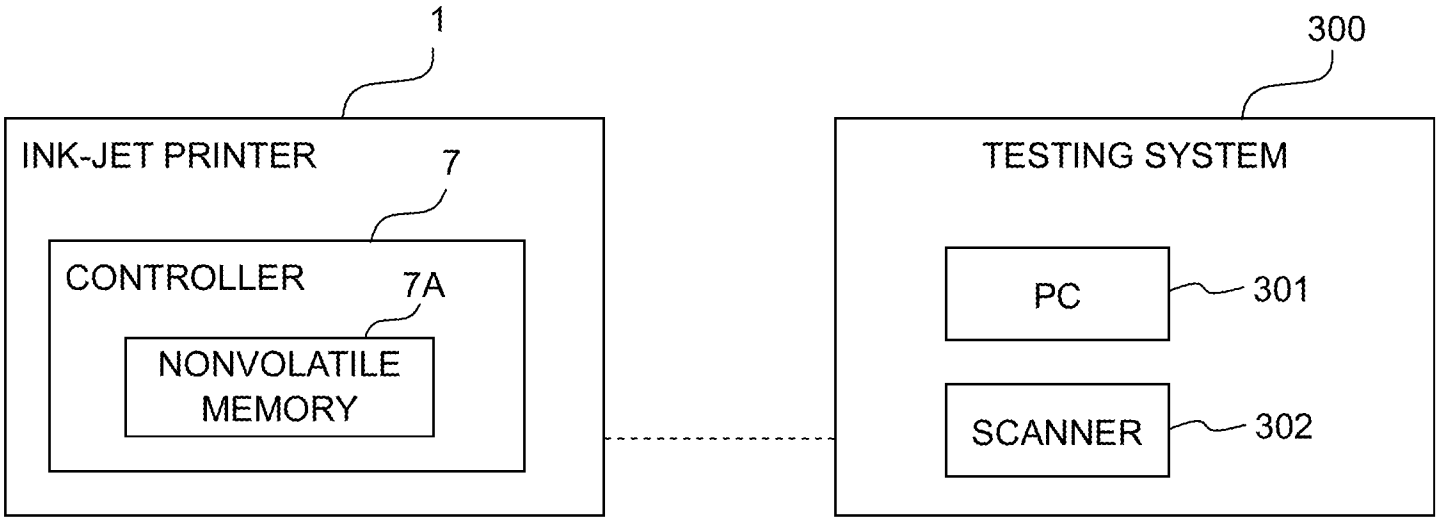
FIG. 11 is a schematic view of a testing system 300.

As shown in FIG. 11, the ink-jet printer 1 and a testing system 300 are prepared. The testing system 300 includes a PC 301 and a scanner 302. The above-described ink-jet printer 1 and testing system 300 are communicably connected.

The 10 items of mask data corresponding to the 10 nozzle pairs are stored in the nonvolatile memory 7A of the controller 7 of the ink-jet printer 1. Each mask data is set so that the difference in use rates of the nozzle NB and the nozzle NC of the corresponding nozzle pair will be a minimum.

Figure 12:
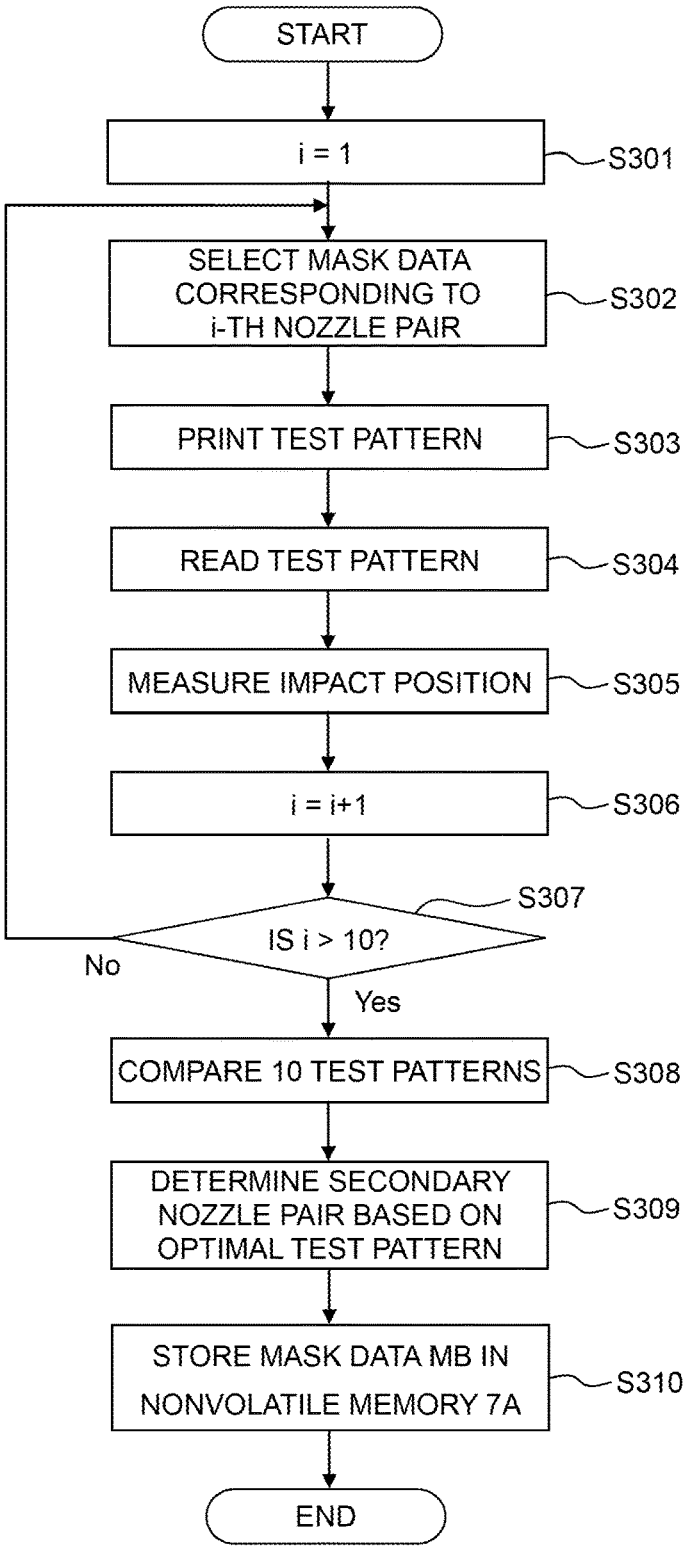
FIG. 12 is a flowchart showing a method for setting mask data M2.

As shown in FIG. 12, the controller 7 sets a variable i to 1 (S301), and selects from among the 10 items of mask data the mask data corresponding to the first nozzle pair (S302). The selected mask data is employed to print the above-mentioned test pattern (solid coating image) (S303), and the test pattern printed as mentioned above is read by the scanner 302 (S304). Then, an extent to which the impact position of ink discharged from the nozzle NB configuring each nozzle pair and the impact position of ink discharged from the nozzle NC configuring each nozzle pair shift with lapse of time, is measured (S305). Specifically, the density unevenness of the test pattern (solid coating image) formed by ink that has impacted from each of the nozzle pairs, is evaluated.

The controller 7 adds 1 to the variable i (S306), and confirms whether the variable i has exceeded 10 (S307). In the case that the variable i does not exceed 10 (S307: No), processing is returned to before step S302, and the above-described steps S302-S306 are repeated. In the case that the variable i exceeds 10 (S307: Yes), extents of shift of impact position of ink in each case of the 10 test patterns, are compared (S308). Then, based on the test pattern whose density unevenness is smallest and that has been judged best, of the 10 test patterns, the position of the secondary nozzle pair is determined from a value of the variable i at that time (S309), and the mask data at that time is stored as the mask data MB, in the nonvolatile memory 7A (S310).

In this way, it is possible to select from the 10 items of mask data optimal mask data capable of suppressing a lowering of printing quality due to the above-described positional shift of impact occurring after start of printing.

In the embodiment described above, the head chip 11 corresponds to a "first liquid discharge head" of the present teaching, and the head chip 12 corresponds to a "second liquid discharge head" of the present teaching. Moreover, the primary nozzle pair ($NB_5$, $NC_5$) corresponds to a "primary nozzle pair" of the present teaching, and the secondary nozzle pair ($NB_4$, $NC_4$) corresponds to a "secondary nozzle pair" of the present teaching.

Next, modified embodiments where various changes have been made to the previously described embodiment will be described. However, configurations of the modified embodiments similar to those of the previously described embodiment will be assigned with the same symbols as those assigned in the previously described embodiment, and descriptions thereof will be appropriately omitted. Note that the modified embodiments shown below are merely exemplifications, and the present teaching is not limited to these. Moreover, the modified embodiments below may also be appropriately combined.

First Modified Embodiment

In the above-described embodiment, in the two nozzle pairs adjacent to the left and the two nozzle pairs adjacent to the right of the primary nozzle pair, the use rate RB of the nozzle NB of each of the nozzle pairs was gradually increased so as to approach 100%, and proportionately, the use rate RC of the nozzle NC of each of the nozzle pairs was gradually decreased so as to approach 0%. Similarly, in the two nozzle pairs adjacent to the left and the two nozzle pairs adjacent to the right of the secondary nozzle pair, the use rate RB of the nozzle NB of each of the nozzle pairs was gradually increased so as to approach 100%, and proportionately, the use rate RC of the nozzle NC of each of the nozzle pairs was gradually decreased so as to approach 0%. However, the present teaching is not limited to such an example. For example, it is possible that in any number of nozzle pairs adjacent to the left and any number of nozzle pairs adjacent to the right of the primary nozzle pair, the use rate RB of the nozzle NB of each of the nozzle pairs is gradually increased so as to approach 100%, and proportionately, the use rate RC of the nozzle NC of each of the nozzle pairs is gradually decreased so as to approach 0%. Similarly, it is possible that in any number of nozzle pairs adjacent to the left and any number of nozzle pairs adjacent to the right of the secondary nozzle pair, the use rate RB of the nozzle NB of each of the nozzle pairs is gradually increased so as to approach 100%, and proportionately, the use rate RC of the nozzle NC of each of the nozzle pairs is gradually decreased so as to approach 0%.

Second Modified Embodiment

Note that in the above-described embodiment, the use rate $RB_5$ of the nozzle NB and the use rate $RC_5$ of the nozzle NC of the primary nozzle pair ($NB_5$, $NC_5$) were each set to 50%. However, the use rate RB of the nozzle NB and the use rate RC of the nozzle NC of the primary nozzle pair (NB, NC) do not necessarily need to be set to exactly 50%. For example, the use rate RB of the nozzle NB configuring the primary nozzle pair and the use rate RC of the nozzle NC configuring the primary nozzle pair can be determined based on a difference in positions in the left-right direction of the nozzle NB and the nozzle NC configuring the primary nozzle pair. Even in this case, the difference between the use rate RB of the nozzle NB and the use rate RC of the nozzle NC of the primary nozzle pair will be smallest of those of all the nozzle pairs, at a time of start of printing.

Third Modified Embodiment

In the previously described embodiment, the mask data MA and the mask data MB were prepared beforehand, and the mask data MA and the mask data MB were switched after a certain time had elapsed after start of printing of a certain page. As a result, the nozzle pair having the smallest difference between the use rate RB of the nozzle NB and the use rate RC of the nozzle NC, of the plurality of nozzle pairs was switched from the primary nozzle pair to the secondary nozzle pair. However, the present teaching is not limited to such a configuration, and, for example, it is also possible for only the mask data MB to be prepared and for the mask data MB to be used from immediately after start of printing of the certain page. In this case also, the difference between the use rate RB of the nozzle NB and the use rate RC of the nozzle NC becomes smallest in the secondary nozzle pair different from the primary nozzle pair having positions of its nozzle NB and its nozzle NC closest in the left-right direction, of the plurality of nozzle pairs.

Fourth Modified Embodiment

In the previously described embodiment, as mentioned above, the mask data MA corresponding to the position of the primary nozzle pair and the mask data MB corresponding to the position of the secondary nozzle pair were stored in advance in the nonvolatile memory 7A. However, it is possible, for example, for the position of the primary nozzle pair and position of the secondary nozzle pair and a plurality of mask data to be stored in the nonvolatile memory 7A, and for the controller 7 to select the mask data MA and the mask data MB from among the plurality of mask data, corresponding to the position of the primary nozzle pair and the position of the secondary nozzle pair.

Fifth Modified Embodiment

In the previously described embodiment, as mentioned above, the mask data MA and the mask data MB were prepared beforehand, and these mask data were switched after a certain time had elapsed after start of printing of a certain page. However, it is possible that beforehand, other mask data is prepared, and optimal mask data is selected based on a certain condition.

As mentioned above, there is thought to be a high possibility that positional shift of impact occurs due to the air current generated in the space where ink droplets fly between the lower surface (the surface where the nozzles are formed) of the ink-jet head 3 and the recording sheet 100. Moreover, strength of the air current is thought to be related to relative speed of the recording sheet 100 and the ink-jet head 3, the gap between the lower surface of the ink-jet head 3 and the recording sheet 100 (the print gap), the print duty, and so on.

Accordingly, due to a prior inspection, a relationship between print duty in the above-described overlap region where printing is performed by the plurality of nozzle pairs and a magnitude of the shift in impact position of the nozzle NB and the nozzle NC, can be found beforehand. Moreover, according to a kind of the recording sheet 100 (for example, plain paper, glossy paper, and so on), thickness of the recording sheet 100 changes, hence the gap between the lower surface of the ink-jet head 3 and the recording sheet 100 (the print gap) changes. Accordingly, a relationship between the kind of recording sheet 100 and the magnitude of the shift in impact position of the nozzle NB and the nozzle NC can be found beforehand. Moreover, a relationship between the relative speed of the recording sheet 100 and the ink-jet head 3 and the magnitude of the shift in impact position of the nozzle NB and the nozzle NC can be found beforehand.

The kind of recording sheet 100, the print duty, and a conveyance speed of the recording sheet 100 are calculated from sent printing data, and on that basis, the relative speed of the recording sheet 100 and the ink-jet head 3, the print gap, and the print duty are calculated. Based on results of the above-described prior inspection, the magnitude of the shift in impact position of the nozzle NB and the nozzle NC is predicted, and which nozzle pair will be the secondary nozzle pair is predicted. Moreover, mask data corresponding to the position of the predicted secondary nozzle pair is selected from a plurality of mask data. Note that the position of the secondary nozzle pair is not necessarily limited to being predicted from the three items of the relative speed of the recording sheet 100 and the ink-jet head 3, the print gap, and the print duty, and the position of the secondary nozzle pair may be predicted using at least one of these three items.

Moreover, the mask data MB corresponding to the secondary nozzle pair may also be generated dynamically. For example, mask data corresponding to the above-mentioned mask data MA is stored in advance in the nonvolatile memory 7A. Then, as mentioned above, the relative speed of the recording sheet 100 and the ink-jet head 3, the print gap, and the print duty are calculated from the sent printing data. On that basis, the magnitude of the shift in impact position of the nozzle NB and the nozzle NC is predicted, and which nozzle pair will be the secondary nozzle pair is predicted. Subsequently, the mask data corresponding to the predicted secondary nozzle pair may be generated dynamically. In this case, it is possible, for example, for mask data to be altered so as to shift the position corresponding to the primary nozzle pair of the mask data MA to the position corresponding to the secondary nozzle pair, whereby the mask data MB is generated from the mask data MA.

Sixth Modified Embodiment

Figure 13:
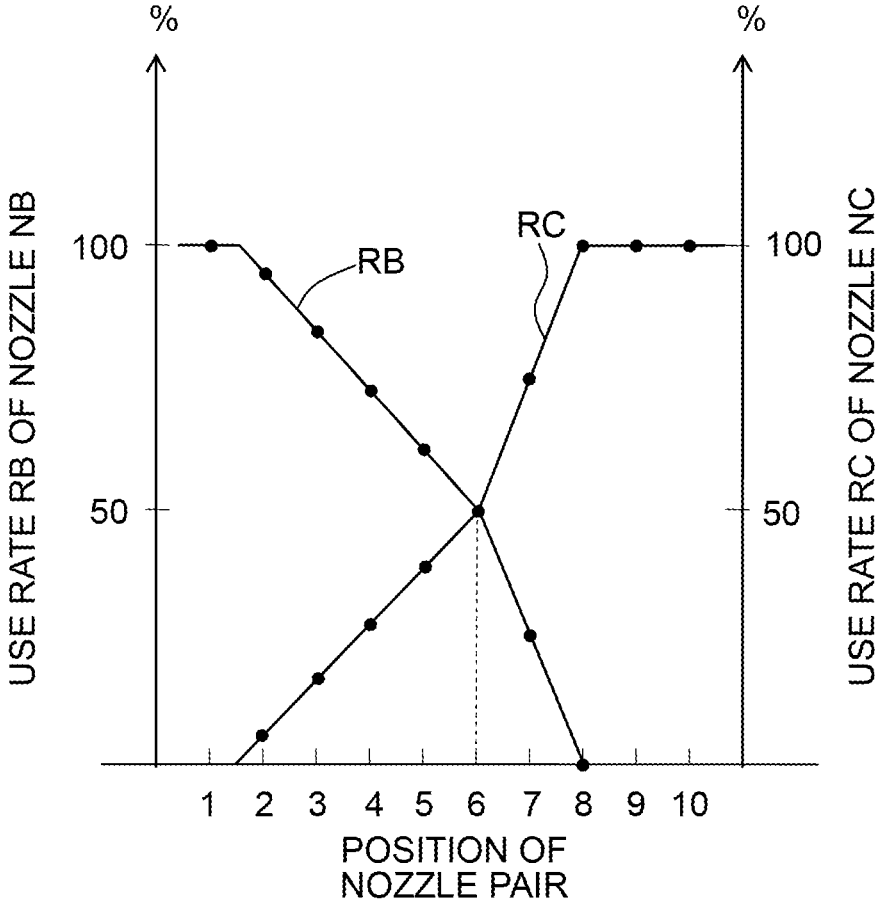
FIG. 13 is a graph showing an example of use rate of the nozzle NB and use rate of the nozzle NC of each of the nozzle pairs determined based on mask data.

In the above-described embodiment, as shown in FIGS. 6 and 8, a rate of change of the use rate RB of the nozzle NB was the same for the nozzle pairs separated to the left and the nozzle pairs separated to the right from the primary (secondary) nozzle pair. Moreover, similarly, a rate of change of the use rate RC of the nozzle NC was the same for the nozzle pairs separated to the left and the nozzle pairs separated to the right from the primary (secondary) nozzle pair. However, the present teaching is not limited to the above-described kind of mode. For example, as shown in FIG. 13, the rate of change of the use rate RB of the nozzle NB may differ for the nozzle pairs separated to the left and the nozzle pairs separated to the right from the secondary nozzle pair. Moreover, similarly, the rate of change of the use rate RC of the nozzle NC may differ for the nozzle pairs separated to the left and the nozzle pairs separated to the right from the secondary nozzle pair. Note that in FIG. 13, the graph is depicted assuming the sixth nozzle pair to be the secondary nozzle pair.

Seventh Modified Embodiment

Moreover, in the above-described embodiment, a total of the use rate RB of the nozzle NB and the use rate RC of the nozzle NC in each of the nozzle pairs was substantially 100%. However, the total of the use rate RB of the nozzle NB and the use rate RC of the nozzle NC may exceed 100%, or may be less than 100%. The case where the total of the use rate RB of the nozzle NB and the use rate RC of the nozzle NC exceeds 100% includes it sometimes being the case that a dot of the dot array of an identical row is formed by impacting both ink discharged from the nozzle NB and ink discharged from the nozzle NC, and that it is not only the case that the dot of the dot array of the identical row is formed by impacting only either one of ink discharged from the nozzle NB and ink discharged from the nozzle NC. Conversely, the case where the total of the use rate RB of the nozzle NB and the use rate RC of the nozzle NC is less than 100% includes the case that, with respect to a dot that rightfully should be formed, sometimes, ink is not discharged from either of the nozzle NB and the nozzle NC and the dot is not formed.

Figure 14:
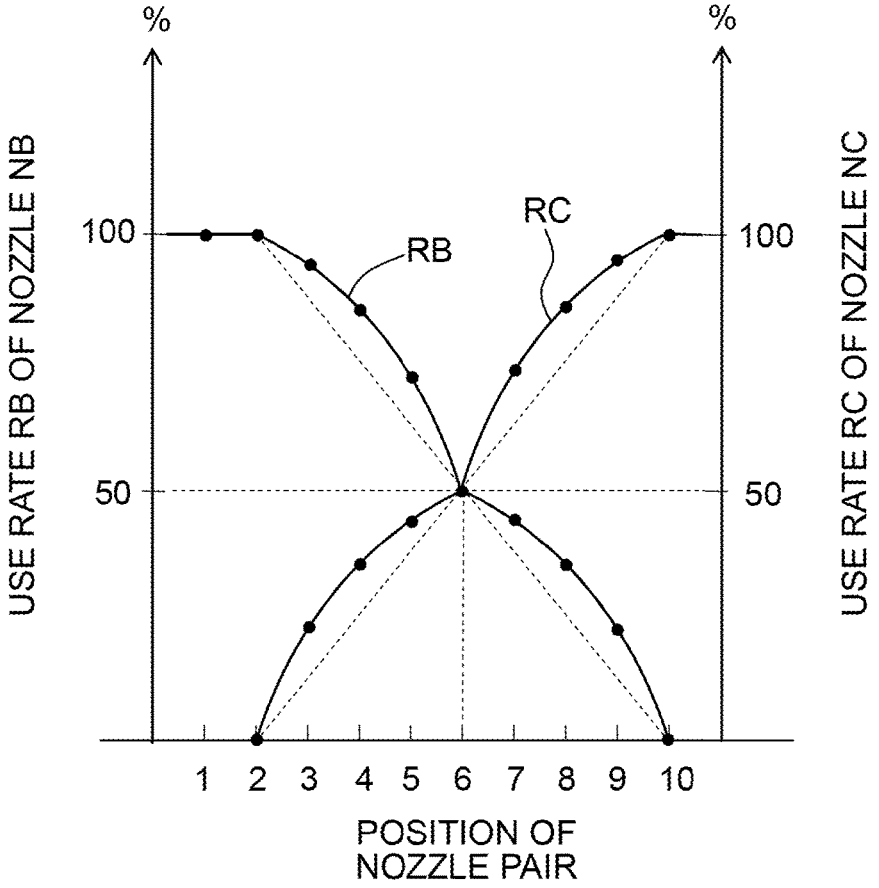
FIG. 14 is a graph showing an example of when a total of the use rate of the nozzle NB and the use rate of the nozzle NC of each of the nozzle pairs exceeds 100%.

For example, as shown in FIG. 14, it is possible to configure so that in a plurality of nozzle pairs to both the left and right side of the secondary nozzle pair, the total of the use rate RB of the nozzle NB and the use rate RC of the nozzle NC will be 100% or more. Note that in FIG. 14 also, the graph is depicted assuming the sixth nozzle pair to be the secondary nozzle pair.

As mentioned above, it is understood that in the case of, for example, forming a solid coating image in the overlap region, a white portion due to density lowering of impact ink occurs more when positional shift of impact has occurred, compared to when positional shift of impact has not occurred at all (refer to FIG. 9). In contrast, by discharging ink in surplus so that, in the plurality of nozzle pairs to both the left and right side of the secondary nozzle pair, the total of the use rate RB of the nozzle NB and the use rate RC of the nozzle NC will be 100% or more, the above-described density lowering of impact ink in the overlap region can be suppressed whereby lowering of printing quality is suppressed.

Note that in FIG. 14, whereas a sum of the use rate $RB_5$ of the nozzle NB and the use rate $RC_5$ of the nozzle NC of the fifth nozzle pair which is the secondary nozzle pair is substantially 100%, a sum of the use rate $RB_4$ of the nozzle NB and the use rate $RC_4$ of the nozzle NC of the fourth nozzle pair which is the nozzle pair adjacent on the left to the secondary nozzle pair is greater than 100%. Similarly, a sum of the use rate $RB_6$ of the nozzle NB and the use rate $RC_6$ of the nozzle NC of the sixth nozzle pair which is the nozzle pair adjacent on the right to the secondary nozzle pair is greater than 100%.

In FIG. 14, a difference between the use rate $RB_5$ of the nozzle NB of the fifth nozzle pair and the use rate $RB_6$ of the nozzle NB of the sixth nozzle pair is larger than a difference between the use rate $RB_4$ of the nozzle NB of the fourth nozzle pair and the use rate $RB_5$ of the nozzle NB of the fifth nozzle pair. A difference between the use rate $RB_4$ of the nozzle NB of the fourth nozzle pair and the use rate $RB_5$ of the nozzle NB of the fifth nozzle pair is larger than a difference between the use rate $RB_3$ of the nozzle NB of the third nozzle pair and the use rate $RB_4$ of the nozzle NB of the fourth nozzle pair. A difference between the use rate $RB_3$ of the nozzle NB of the third nozzle pair and the use rate $RB_4$ of the nozzle NB of the fourth nozzle pair is larger than a difference between the use rate $RB_2$ of the nozzle NB of the second nozzle pair and the use rate $RB_3$ of the nozzle NB of the third nozzle pair. A difference between the use rate $RB_2$ of the nozzle NB of the second nozzle pair and the use rate $RB_3$ of the nozzle NB of the third nozzle pair is larger than a difference between the use rate $RB_1$ of the nozzle NB of the first nozzle pair and the use rate $RB_2$ of the nozzle NB of the second nozzle pair.

In FIG. 14, a difference between the use rate $RB_6$ of the nozzle NB of the sixth nozzle pair and the use rate $RB_7$ of the nozzle NB of the seventh nozzle pair is smaller than a difference between the use rate $RB_7$ of the nozzle NB of the seventh nozzle pair and the use rate $RB_8$ of the nozzle NB of the eighth nozzle pair. A difference between the use rate $RB_7$ of the nozzle NB of the seventh nozzle pair and the use rate $RB_8$ of the nozzle NB of the eighth nozzle pair is smaller than a difference between the use rate $RB_8$ of the nozzle NB of the eighth nozzle pair and the use rate $RB_9$ of the nozzle NB of the ninth nozzle pair. A difference between the use rate $RB_8$ of the nozzle NB of the eighth nozzle pair and the use rate $RB_9$ of the nozzle NB of the ninth nozzle pair is smaller than a difference between the use rate $RB_9$ of the nozzle NB of the ninth nozzle pair and the use rate $RB_{10}$ of the nozzle NB of the tenth nozzle pair.

In FIG. 14, a difference between the use rate $RC_7$ of the nozzle NC of the seventh nozzle pair and the use rate $RC_6$ of the nozzle NC of the sixth nozzle pair is larger than a difference between the use rate $RC_8$ of the nozzle NC of the eighth nozzle pair and the use rate $RC_7$ of the nozzle NC of the seventh nozzle pair. A difference between the use rate $RC_8$ of the nozzle NC of the eighth nozzle pair and the use rate $RC_7$ of the nozzle NC of the seventh nozzle pair is larger than a difference between the use rate $RC_9$ of the nozzle NC of the ninth nozzle pair and the use rate $RC_8$ of the nozzle NC of the eighth nozzle pair. A difference between the use rate $RC_9$ of the nozzle NC of the ninth nozzle pair and the use rate $RC_8$ of the nozzle NC of the eighth nozzle pair is larger than a difference between the use rate $RC_{10}$ of the nozzle NC of the tenth nozzle pair and the use rate $RC_9$ of the nozzle NC of the ninth nozzle pair.

In FIG. 14, a difference between the use rate $RC_6$ of the nozzle NC of the sixth nozzle pair and the use rate $RC_5$ of the nozzle NC of the fifth nozzle pair is smaller than a difference between the use rate $RC_5$ of the nozzle NC of the fifth nozzle pair and the use rate $RC_4$ of the nozzle NC of the fourth nozzle pair. A difference between the use rate $RC_5$ of the nozzle NC of the fifth nozzle pair and the use rate $RC_4$ of the nozzle NC of the fourth nozzle pair is smaller than a difference between the use rate $RC_4$ of the nozzle NC of the fourth nozzle pair and the use rate $RC_3$ of the nozzle NC of the third nozzle pair. A difference between the use rate $RC_4$ of the nozzle NC of the fourth nozzle pair and the use rate $RC_3$ of the nozzle NC of the third nozzle pair is smaller than a difference between the use rate $RC_3$ of the nozzle NC of the third nozzle pair and the use rate $RC_2$ of the nozzle NC of the second nozzle pair.

Note that in the seventh modified embodiment, description has been made exemplifying the case where, in the plurality of nozzle pairs on both left and right sides of the secondary nozzle pair, the total of the use rate RB of the nozzle NB and the use rate RC of the nozzle NC exceeds 100%. However, the present teaching is not limited to this. For example, it is possible that in one or a plurality of nozzle pairs on one of left and right sides of the secondary nozzle pair, the total of the use rate RB of the nozzle NB and the use rate RC of the nozzle NC exceeds 100%. Moreover, in one or a plurality of nozzle pairs on both left and right sides (or on one of left and right sides) of the secondary nozzle pair, the total of the use rate RB of the nozzle NB and the use rate RC of the nozzle NC need not necessarily exceed 100% and need only be larger than the total of the use rate RB of the nozzle NB and the use rate RC of the nozzle NC of the secondary nozzle pair.

Eighth Modified Embodiment

In the seventh modified embodiment, description was made focusing on the secondary nozzle pair and exemplifying the case where, in at least one nozzle pair on both left and right sides (or on one side) of the secondary nozzle pair, the total of the use rate RB of the nozzle NB and the use rate RC of the nozzle NC exceeded the total of the use rate RB of the nozzle NB and the use rate RC of the nozzle NC of the secondary nozzle pair. However, the present teaching is not limited to this. For example, in such cases as when the conveyance speed of the recording sheet is slow, the above-mentioned kind of phenomenon of the impact position of the nozzle NB and the nozzle NC after start of printing ending up shifting does not occur. In such a case, focusing on the primary nozzle pair and setting the use rate RB of the nozzle NB and the use rate RC of the nozzle NC of the primary nozzle pair and the use rate RB of the nozzle NB and the use rate RC of the nozzle NC of at least one nozzle pair on both left and right sides (or on one side) of the primary nozzle pair similarly to in the above-mentioned seventh modified embodiment, is effective for suppressing density lowering of impact ink and thereby suppressing a lowering of printing quality.

In the case that the above-mentioned kind of phenomenon of the impact position of the nozzle NB and the nozzle NC after start of printing ending up shifting does not occur, ink discharged from the nozzle NB and the nozzle NC of the primary nozzle pair impacts at substantially the same position in the left-right direction. Positions of the nozzle NB and the nozzle NC configuring the nozzle pair shift little by little with increasing separation to both left and right sides from the primary nozzle pair. As a result, ink discharged from the nozzle NB and the nozzle NC of the nozzle pair separated from the primary nozzle pair impacts at positions out of alignment in the left-right direction. Therefore, density lowering of impact ink ends up occurring. However, in the present modified embodiment, in the nozzle pair separated from the primary nozzle pair, ink is discharged in surplus so that the total of the use rate RB of the nozzle NB and the use rate RC of the nozzle NC will be greater than that of the primary nozzle pair. Therefore, density lowering of impact ink can be suppressed, whereby lowering of printing quality is suppressed. This kind of technology is useful in an ink-jet printer configured so as to cooperatively form a dot array of an identical row by employing two head chips having different nozzle pitches as in the present teaching.

In the previously described embodiment and modified embodiments, the number of nozzles NA and nozzles ND were each 90, and the number of nozzles NB and nozzles NC were each 10. However, these numbers of nozzles are merely illustrative, and it goes without saying that the numbers of nozzles may be appropriately changed. Moreover, each of the ink-jet heads 3 included two head chips, but may include three or more head chips.

In the embodiment and modified embodiments described above, the present teaching was applied to the ink-jet printer 1 of line type that discharges ink onto a recording sheet to print an image or the like. However, the present teaching is not limited to being applied to a line type ink-jet printer, and may be applied also to a serial type ink-jet printer. Moreover, the present teaching is not limited to being applied to an ink-jet printer that conveys recording sheets one at a time, and may be applied also to an ink-jet printer that performs printing while continuously conveying a sheet wound in a roll. The present teaching is not limited to being applied to an ink-jet printer that discharges ink to print an image, and may be applied also to a liquid discharge apparatus used in a variety of applications besides printing of an image or the like. For example, it is possible to apply the present teaching also to a liquid discharge apparatus that discharges a conductive liquid onto a substrate to form a conductive pattern on a substrate surface.

What is claimed is:

1. A liquid discharge apparatus configured to discharge droplets of liquid onto a medium, comprising:

a first liquid discharge head including:

a first end;

a second end separated from the first end in a first direction;

n of nozzles $NA_1$-$NA_n$ located between the first end and the second end in the first direction, and aligned in the first direction with a first pitch from the first end toward the second end; and m of nozzles $NB_1$-$NB_m$ located between the nozzle $NA_n$ and the second end in the first direction and aligned in the first direction from the nozzle $NA_n$ toward the second end with a second pitch different from the first pitch;

a second liquid discharge head aligned with the first liquid discharge head in a second direction orthogonal to the first direction, including:

a third end;

a fourth end separated from the third end in the first direction;

m of nozzles $NC_1$-$NC_m$ located between the third end and the fourth end in the first direction, and aligned in the first direction from the third end toward the fourth end with the first pitch; and a controller configured to control the first liquid discharge head and the second liquid discharge head, wherein the first and second liquid discharge heads include m of nozzle pairs ($NB_1$, $NC_1$)-($NB_m$, $NC_m$), wherein the controller is configured to cooperatively form a dot array extending in the second direction, on the medium moving in the second direction relatively to the first and second liquid discharge heads, for each of the m of nozzle pairs ($NB_1$, $NC_1$)-($NB_m$, $NC_m$), wherein in a case of cooperatively forming the dot array extending in the second direction on the medium moving in the second direction relatively to the first and second liquid discharge heads, the controller is configured to control the first liquid discharge head and the second liquid discharge head to discharge droplets from the nozzle $NB_i$ at a use rate $RB_i$ and discharge droplets from the nozzle $NC_i$ at a use rate $RC_i$, by the i-th ($1 \le i \le m$) nozzle pair ($NB_i$, $NC_i$), wherein a difference of position between the nozzle $NB_j$ and the nozzle $NC_j$ in the first direction is smallest in the j-th nozzle pair ($NB_j$, $NC_j$), of the m of nozzle pairs ($NB_1$, $NC_1$)-($NB_m$, $NC_m$), and wherein a difference between the use rate $RB_p$ of the nozzle $NB_p$ and the use rate $RC_p$ of the nozzle $NC_p$ is smallest in the p-th nozzle pair ($NB_p$, $NC_p$) different from the j-th nozzle pair ($NB_j$, $NC_j$), of the m of nozzle pairs ($NB_1$, $NC_1$)-($NB_m$, $NC_m$).

2. The liquid discharge apparatus according to claim 1, wherein the use rate $RB_1$ of the nozzle $NB_1$ in the first nozzle pair ($NB_1$, $NC_1$) and the use rate $RC_m$ of the nozzle $NC_m$ in the m-th nozzle pair ($NB_m$, $NC_m$) are both 100%, and wherein the use rate $RC_1$ of the nozzle $NC_1$ in the first nozzle pair ($NB_1$, $NC_1$) and the use rate $RB_m$ of the nozzle $NB_m$ in the m-th nozzle pair ($NB_m$, $NC_m$) are both 0%.

3. The liquid discharge apparatus according to claim 1, wherein in a case of cooperatively forming the dot array extending in the second direction, on the medium moving in the second direction relatively to the first and second liquid discharge heads, the controller switches between controlling the first liquid discharge head and the second liquid discharge head to discharge droplets from each of the nozzle pairs so that a difference between the use rate $RB_j$ of the nozzle $NB_j$ and the use rate $RC_p$ of the nozzle $NC_j$ will be smallest of the m nozzle pairs in the j-th nozzle pair ($NB_j$, $NC_j$), and controlling the first liquid discharge head and the second liquid discharge head to discharge droplets from each of the nozzle pairs so that a difference between the use rate $RB_p$ of the nozzle $NB_p$ and the use rate $RC_p$ of the nozzle $NC_p$ will be smallest of the m nozzle pairs in the p-th nozzle pair ($NB_p$, $NC_p$) different from the j-th nozzle pair ($NB_j$, $NC_j$).

4. The liquid discharge apparatus according to claim 3, wherein the p-th nozzle pair is closer to the first nozzle pair than the j-th nozzle pair.

5. The liquid discharge apparatus according to claim 3, wherein the p-th nozzle pair is closer to the m-th nozzle pair than the j-th nozzle pair.

6. The liquid discharge apparatus according to claim 1, wherein the controller includes a memory storing a plurality of mask data, and wherein in a case of cooperatively forming the dot array extending in the second direction, with respect to the medium moving in the second direction relatively to the first and second liquid discharge heads, the controller is configured to select one mask data from the plurality of mask data, based on one of a discharge duty of the medium, a relative speed of the first and second liquid discharge heads relative to the medium, and a distance from a nozzle surface of the first and second liquid discharge heads to an upper surface of the medium.

7. The liquid discharge apparatus according to claim 1, wherein a sum of the use rate $RB_{p-1}$ of the nozzle $NB_{p-1}$ and the use rate $RC_{p-1}$ of the nozzle $NC_{p-1}$ of the (p−1)-th nozzle pair ($NB_{p-1}$, $NC_{p-1}$) is larger than a sum of the use rate $RB_p$ of the nozzle $NB_p$ and the use rate $RC_p$ of the nozzle $NC_p$ of the p-th nozzle pair ($NB_p$, $NC_p$).

8. The liquid discharge apparatus according to claim 1, wherein a sum of the use rate $RB_{p+1}$ of the nozzle $NB_{p+1}$ and the use rate $RC_{p+1}$ of the nozzle $NC_{p+1}$ of the (p+1)-th nozzle pair ($NB_{p+1}$, $NC_{p+1}$) is larger than a sum of the use rate $RB_p$ of the nozzle $NB_p$ and the use rate $RC_p$ of the nozzle $NC_p$ of the p-th nozzle pair ($NB_p$, $NC_p$).

9. The liquid discharge apparatus according to claim 1, wherein in a case of cooperatively forming the dot array extending in the second direction on the medium moving in the second direction relatively to the first and second liquid discharge heads, a magnitude of a shift in position in the first direction between an impact position impacted on by droplets discharged from the nozzle $NB_p$ and an impact position impacted on by droplets discharged from the nozzle $NC_p$ of the p-th nozzle pair ($NB_p$, $NC_p$) is smallest among the m nozzle pairs ($NB_1$, $NC_1$)-($NB_m$, $NC_m$).

10. A liquid discharge apparatus configured to discharge droplets of liquid onto a medium, comprising:

a first liquid discharge head including:

a first end;

a second end separated from the first end in a first direction;

n of nozzles $NA_1$-$NA_n$ located between the first end and the second end in the first direction, and aligned in the first direction with a first pitch from the first end toward the second end; and m of nozzles $NB_1$-$NB_m$ located between the nozzle $NA_n$ and the second end in the first direction, and aligned in the first direction from the nozzle $NA_n$ toward the second end with a second pitch different from the first pitch;

a second liquid discharge head aligned with the first liquid discharge head in a second direction orthogonal to the first direction, including:

a third end;

a fourth end separated from the third end in the first direction;

m of nozzles $NC_1$-$NC_m$ located between the third end and the fourth end in the first direction, and aligned in the first direction from the third end toward the fourth end with the first pitch; and a controller configured to control the first liquid discharge head and the second liquid discharge head, wherein the first and second liquid discharge heads include m of nozzle pairs ($NB_1$, $NC_1$)-($NB_m$, $NC_m$), wherein the controller is configured to cooperatively form a dot array extending in the second direction, on the medium moving in the second direction relatively to the first and second liquid discharge heads, for each of the m of nozzle pairs ($NB_1$, $NC_1$)-($NB_m$, $NC_m$), wherein in a case of cooperatively forming the dot array extending in the second direction, on the medium moving in the second direction relatively to the first and second liquid discharge heads, the controller is configured to control the first liquid discharge head and the second liquid discharge head to discharge droplets from the nozzle $NB_i$ at a use rate $RB_i$ and discharge droplets from the nozzle $NC_i$ at a use rate $RC_i$, by the i-th ($1 \leq i \leq m$) nozzle pair ($NB_i$, $NC_i$), wherein a difference of position between the nozzle $NB_j$ and the nozzle $NC_j$ in the first direction being smallest in the j-th nozzle pair ($NB_j$, $NC_j$), wherein a difference between the use rate $RB_j$ of the nozzle $NB_j$ and the use rate $RC_j$ of the nozzle $NC_j$ being smallest in the j-th nozzle pair ($NB_j$, $NC_j$), wherein a sum of the use rate $RB_{j-1}$ of the nozzle $NB_{j-1}$ and the use rate $RC_{j-1}$ of the nozzle $NC_{j-1}$ of the (j−1)-th nozzle pair ($NB_{j-1}$, $NC_{j-1}$) is larger than a sum of the use rate $RB_j$ of the nozzle $NB_j$ and the use rate $RC_j$ of the nozzle $NC_j$ of the j-th nozzle pair ($NB_j$, $NC_j$), and wherein a sum of the use rate $RB_{j+1}$ of the nozzle $NB_{j+1}$ and the use rate $RC_{j+1}$ of the nozzle $NC_{j+1}$ of the (j+1)-th nozzle pair ($NB_{j+1}$, $NC_{j+1}$) is larger than the sum of the use rate $RB_j$ of the nozzle $NB_j$ and the use rate $RC_j$ of the nozzle $NC_j$ of the j-th nozzle pair ($NB_j$, $NC_j$).

* * * * *